United States Patent [19]

Simon

[11] Patent Number: 4,593,418

[45] Date of Patent: Jun. 10, 1986

[54] METHOD AND SEAM CONSTRUCTION TO SIGNIFICANTLY REDUCE SEAM LEAKAGE

[75] Inventor: Gene F. Simon, Marietta, Ga.

[73] Assignee: Kimberly-Clark Corporation, Neenah, Wis.

[21] Appl. No.: 614,933

[22] Filed: May 29, 1984

[51] Int. Cl.[4] ..... A41D 27/24

[52] U.S. Cl. ..... 2/275; 112/417; 112/418

[58] Field of Search ..... 2/275; 112/417, 418, 112/419

[56] References Cited

U.S. PATENT DOCUMENTS

| | | | |
|---|---|---|---|
| 1,706,461 | 3/1929 | Oathout | 112/418 X |
| 1,725,749 | 8/1929 | Blair | 2/275 X |
| 2,115,368 | 4/1938 | Lustberg | 2/275 X |
| 2,372,632 | 3/1945 | Webb | 2/275 X |
| 2,624,886 | 1/1953 | Herman | 112/418 X |
| 4,152,783 | 5/1979 | Choksi | 2/168 |

FOREIGN PATENT DOCUMENTS

| | | | |
|---|---|---|---|
| 843531 | 7/1952 | Fed. Rep. of Germany | 2/275 |

*Primary Examiner*—H. Hampton Hunter

*Attorney, Agent, or Firm*—William D. Herrick

[57] ABSTRACT

Self-sealing seam construction for recreational fabrics and other uses reducing the tendency to permit water penetration and leaking. The seam includes the use of one of a number of overlapping type seams formed with water resistant fabrics. In the overlapped area, between the fabrics, a strip or tape of highly resilient, nontacky, weather resistant elastomeric material is provided. The seam is formed by one or more stitching lines placed so that the sewing needle penetrates not only the overlapped fabrics but the elastomeric strip as well. The highly resilient nature of the elastomeric strip causes it to stretch and eventually aperture under the action of the needle and, when the needle is withdrawn, the elastic strip tends to return to its original position thus closing the aperture tightly around the thread positioned within the aperture by the sewing needle. The result is a tightly formed seal minimizing any open area remaining from the sewing operation. Preferred elastomeric strip materials also include those having a high ultimate elongation, preferably in the range of from about 400 to 750%, high ultimate tensile, preferably in the range of from about 2500 to 4200 psi, in cases where the ultimate elongation is less than about 400%, a high rebound, preferably in the range of from about 33% to 49% and a low permanent set, preferably less than about 35%. In addition, the elastomeric strip preferably is nontacky and thin so as to not unduly exaggerate the overall seam thickness and is wider than the stitching width while narrower than the overall seam width. Specific examples include a neoprene elastomer tape having a thickness of 0.030 in., width of 0.75 in., ultimate elongation of 750%, ultimate tensile strength of 3200 psi, and modulus at 500 percent stretch of 9000 psi used in seaming a combination of polypropylene nonwoven fabrics as recreational fabric material. Other preferred embodiments include seamed constructions wherein the edges are folded over to avoid raw edge exposure for improved appearance.

9 Claims, 5 Drawing Figures

METHOD AND SEAM CONSTRUCTION TO SIGNIFICANTLY REDUCE SEAM LEAKAGE

BACKGROUND OF THE INVENTION

1. Field of the Invention

This invention relates to seaming of water-resistant materials and especially those intended for recreational fabric uses. While the ever growing interest in outdoor activities such as camping has resulted in significant improvements to base fabric materials used for campers, tents, garments and the like, the size or construction of articles used for these purposes frequently requires seaming of one or more component materials. The present invention is directed to methods for forming such seams and the resulting seamed materials.

2. Description of the Prior Art

The subject of seam sealing for recreational fabrics and the like has received considerable attention, and the solution to this persistent problem has been proposed in a number of forms. A common approach has been to apply a cover strip or tape of various materials over the seam after it has been formed. For example, U.S. Pat. No. 3,294,617 to Way dated Dec. 27, 1966, U.S. Pat. No. 3,246,621 to Copeland dated Apr. 19, 1966, U.S. Pat. No. 4,190,010 to Bibby dated Feb. 26, 1980, and U.S. Pat. No. 2,988,457 to Gatcomb dated June 13, 1961 teach varying embodiments of this concept. In addition, the use of sealing cement has been tried, and U.S. Pat. No. 4,305,414 to Bareis dated Dec. 15, 1981 is an example relating to this approach. In other cases reinforcing strips have also been taught as proving resistance to seam leakage and U.S. Pat. No. 3,328,854 to Tombari dated July 4, 1967 as well as U.S. Pat. No. 3,987,592 to Herminghaus and Jablonka dated Oct. 26, 1976 contain teachings of this type. It has also been proposed to bury the construction of the seam itself, so as to prevent or reduce seam leakage. U.S. Pat. No. 3,090,047 to de Grazia dated May 21, 1963 and U.S. Pat. No. 3,880,459 to Kelley dated Apr. 29, 1975 describe such seam constructions. In yet another approach, U.S. Pat. No. 4,416,027 to Perla dated Nov. 22, 1983, a filler strip is inserted by cutting abutting layers. Finally, it has been proposed to insert a strip of malleable rubber material in the stitching zone between the materials to be seamed. In U.S. Pat. No. 2,624,886 to Herman dated Jan. 13, 1953, such a seam is described; however, to achieve the desired result it is necessary to subject the sealed seam to pressure in order to force the tacky elastomer around the threads and seal the needle apertures. The tacky nature causes the elastomer to accumulate on needles producing frequent interruptions in stitching. Furthermore, the described elastomer tape is a rather complex multilayer laminate construction of vulcanized and unvulcanized rubber with a supporting layer. In spite of these many attempted improvements to achieve a waterproof seam for recreational and other types of fabrics, a completely satisfactory solution has not been identified as the serious recreational campers and manufacturers will know. Particularly with the newer, nonwoven fabric materials, the needle apertures caused by stitching remain sufficiently open to cause tents and the like to leak through the seamed areas particularly under prolonged, heavy rainy conditions. Thus, a need exists for further improvements which reduce or eliminate this seam leaking tendency.

SUMMARY OF THE INVENTION

The present invention is directed to an improved, leak resistant seam construction for recreational and other fabrics requiring water-resistant or waterproof properties. The seam and seamed fabrics of the present invention find particular utility with nonwoven fabrics used for tents, tarpaulins, boat covers, campers and the like. In accordance with the invention, the particular configuration of the seam, itself, may vary but will contain an area or strip where the materials to be seamed overlap, and a particular elastomeric strip will be interposed between the materials within the overlap area. Thus, the seam may simply be two overlapping layers with a highly resilient, nontacky elastomeric material therebetween, or the seam may include a structure wherein each layer is reverse folded and the reverse folds are overlapped with the elastomeric tape in the overlapping area. The stitching will take place through the materials and the elastomeric tape or strip. In accordance with the invention improved seam sealing is obtained through the use of a highly resilient, nontacky elastomeric tape interposed between the layers in the seam area and through which the stitching takes place. Through selection of the highly resilient tape properties, in accordance with the invention, the needle apertures are substantially closed and sealed around the thread thus greatly reducing the tendency to leak through the needle apertures. It is important that the elastomeric tape exhibit a specific combination of properties. It must have a high ultimate elongation, broadly within the range of from about 300% to 1000% and preferably within the range of from about 400% to 750%. The ultimate tensile strength must be within the broad range of from about 2000 psi to 5000 psi and, preferably is within the range of from about 2500 psi to about 4200 psi. When the ultimate elongation is less than about 400% it also must have a high rebound broadly within the range of from about 25% to about 60% and, preferably, within the range of from about 33% to 49%. Finally, the elastomeric tape must have a low permanent set, broadly less than about 40%, and, preferably, less than about 35%. The tape will also preferably have a thickness in the range from 0.005 inch to 0.100 inch and a width selected in accordance with the desired seaming but, generally, in a range from about 0.250 inch to 6.00 inches. The resulting structure, when employed with nonwoven fabrics, particularly, is highly effective in reducing the tendency to leak and exhibits much improved hydrohead test results. As such it is extremely useful for seaming of recreational fabrics intended for the construction of tents, boat and trailer covers, tarpaulins and the like.

DESCRIPTION OF THE PREFERRED EMBODIMENTS

While the invention will be described in connection with preferred embodiments, it will be understood that it is not intended to limit the invention to those embodiments. On the contrary, it is intended to cover all alternatives, modifications, and equivalencs as may be included within the spiriy and scope of the invention as defined by the appended claims.

Certain test results are included below in describing results obtained in accordance with the present invention. For completeness the following describes the nature of these tests Ultimte Elongation (%), Ultimate Tensile Strength (p.s.i.) and Modulus (p.s.i.)

The elongation, tensile and modulus results were determined by ANSI/ASTM Test D412 of *Standard Methods for Testing Rubber Properties in Tension,* parts 12.2, 13.1, and 14.

Rebound

Rebound test results were obtained by ANSI/ASTM Test 2632.

Permanent Set

Permanent set results were obtained by ANSI/ASTM Test D412 Part 13.2.

Hydrohead

Hydrohead test results were obtained by Federal Test Method Standard 191 Method #5514. While no specific industrial standards have been set, it is generally considered that a value of at least 35 cm is necessary for good performance.

Rain Spray

Rain spray test results were obtained by Federal Test Method Standard 191 Method #5524. While no specific industrial standards have been set, it is generally considered that a test result of 2 grams or less is necessary for good performance.

The fabrics with which the present invention may advantageously be employed include a wide range of nonwoven and woven materials. Such include, for example, spunbonded webs, meltblown webs, and combinations such as are described, for example, in U.S. Pat. No. 4,374,888 to Bornslaeger dated Feb. 22, 1983. While the basis weight for such fabrics is not critical, the invention is of greatest benefit with heavier basis weight materials such as, for example, in the range of from about 2 oz/yd$^2$ to 20 oz/yd$^2$ and preferably from 4 oz/yd$^2$ to 15 oz/yd$^2$ where stitching is required to obtain strong seams. For other lighter basis weight materials, different seam bonding techniques may be employed which may not require perforation of the web. However, for the needled webs, particularly for nonwoven fabrics, needling as currently practiced tends to leave apertures in the fabric which are not completely filled by the thread. In use, particularly when stressed, these tend to permit water to pass through the fabric producing leaks. The tendency may be readily confirmed by observing light through such a seamed fabric which will reveal the needle apertures. These apertures occur whether the fabric is seamed by simple overlap or by a reverse fold type overlap seam.

Figure 1:
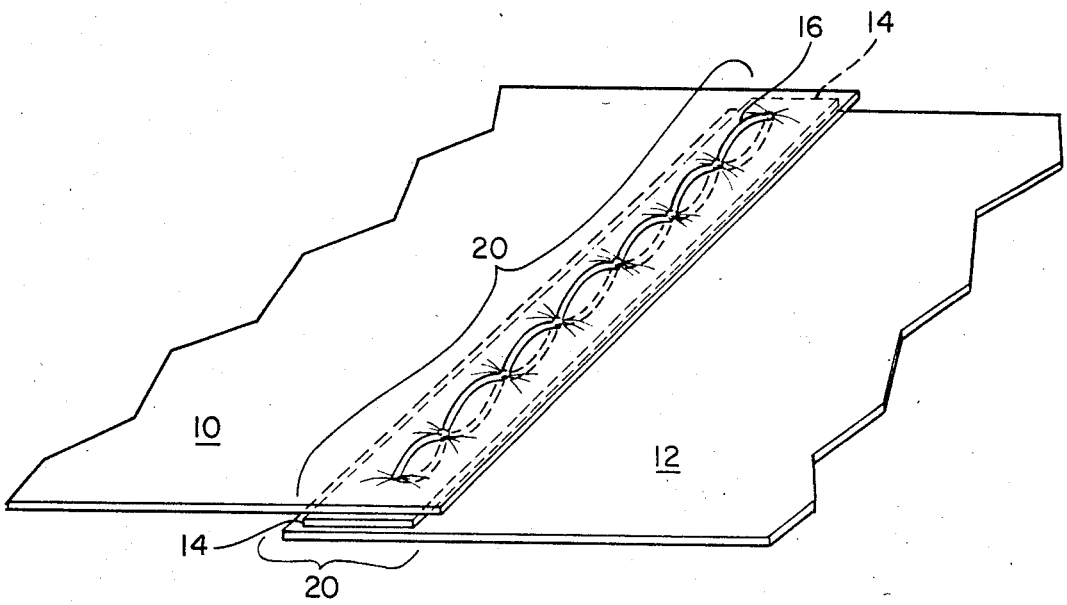
FIG. 1 illustrates a simple overlap seam constructed in accordance with the invention.
Figure 2:
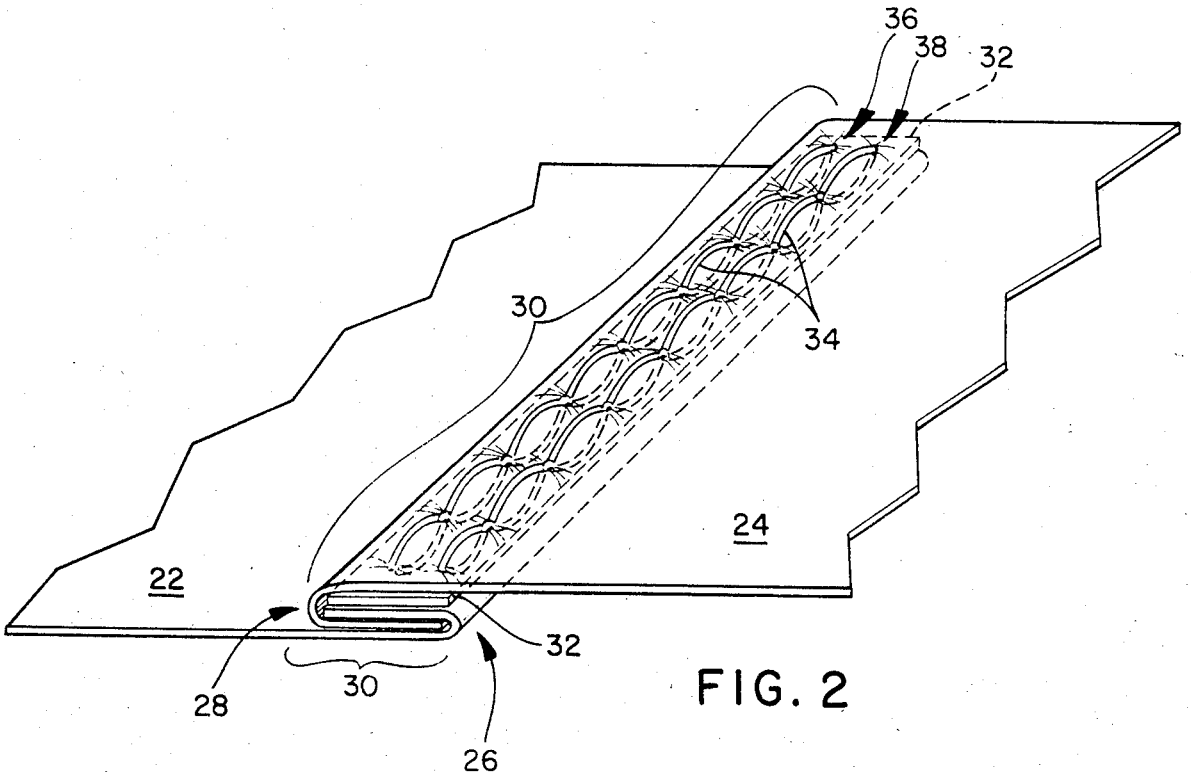
FIG. 2 illustrates an alternative reverse fold overlap seam in accordance with the invention.

Turning to FIG. 1, there is schematically shown in perspective a seam in accordance with the present invention. As shown, nonwoven fabric 10 and nonwoven fabric 12 are stitched in overlapping zone 20 by thread 16. Interposed between the layers in overlapped zone 20 is highly resilient, nontacky elastomeric tape 14. As shown, the thread 16 passes through the nonwoven and elastomeric materials with the elastomeric materials closed tightly about thread 16. FIG. 2 is a similar illustration of an alternative seaming structure involving reverse folded layers ("lap fell seam"). As shown, webs 22 and 24 are reverse folded upon each at opposite ends 26 and 28 so as to form overlapping zone 30. In the overlapping zone 30 is located highly resilient elastomeric strip 32. Thread 34 in double rows 36 and 38 penetrate through all layers thus sewing the seam. As shown, again the resilient strip closes tightly against the thread 34 to seal the needle apertures.

Figure 3:
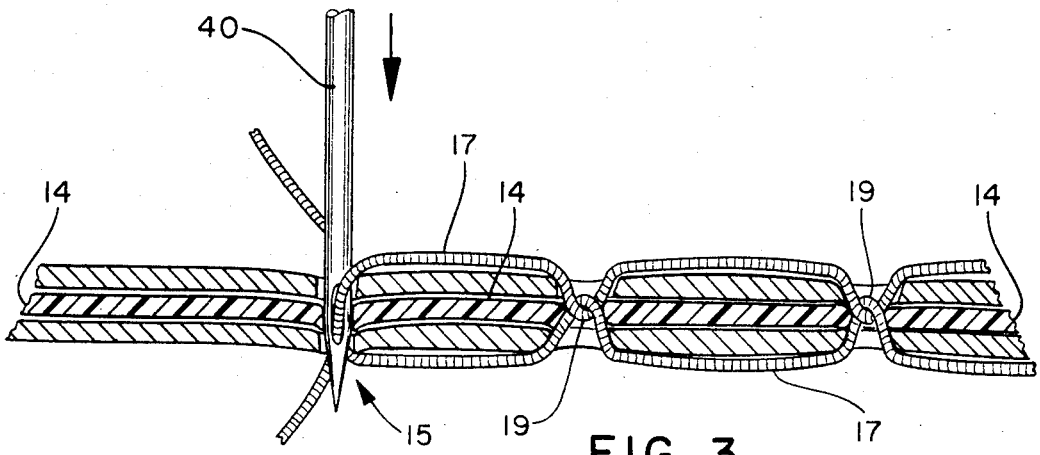
FIG. 3 illustrates in cross-section the penetration of the needle through the seam structure of the present invention.
Figure 4:
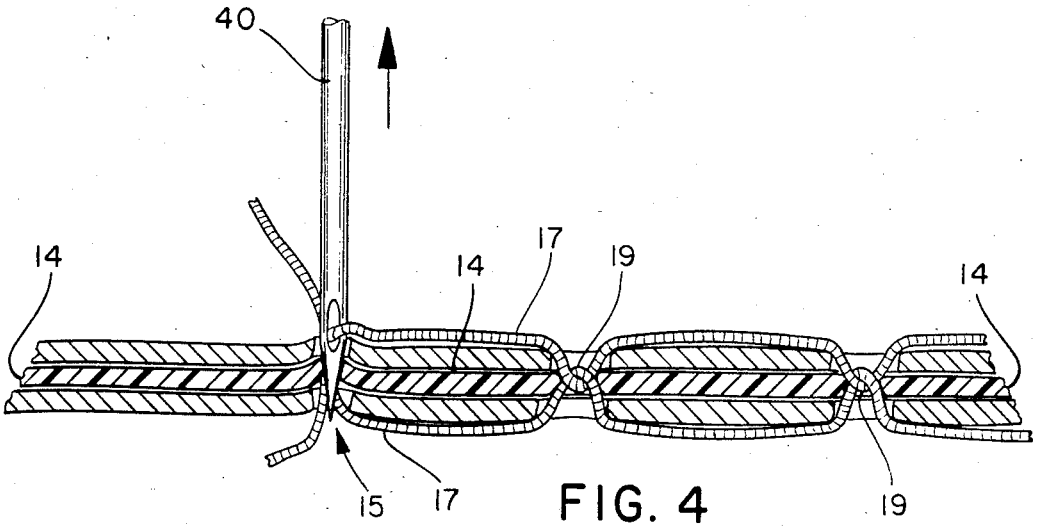
FIG. 4 similarly illustrates removal of the needle.
Figure 5:
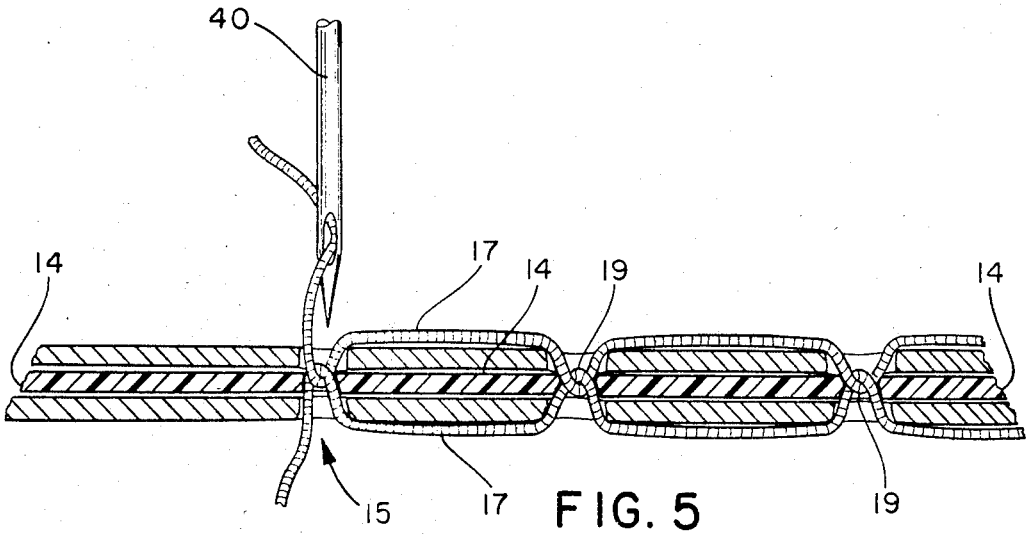
FIG. 5 similarly illustrates the resulting stitch area.

The elastomeric material selected is essential to obtaining the benefits of the present invention. Thus, the elastomeric material must be highly resilient, nontacky and, for most applications, resistant to weathering. Turning to FIGS. 3 through 5, while it is not desired to limit the invention to any particular theory, it is believed that the elastic material 14 yields significantly when subjected to the needle stress and the aperture 15 created by the needle 40 is achieved under stretched conditions. Similarly, when the needle 40 is removed as shown in FIG. 4, it is also under stressed conditions. As a result, as shown in FIG. 5, when the needle 40 has been completely removed, the elastomeric material 14 tends to return to its original condition thus closing the needle aperture 15 about the thread 17 in twist area 19. The needle apertures 15 created under stressed conditions as described will tend to be smaller and even further improve the sealing effect.

To achieve these results it is also important that the elastomeric tape permit ultimate elongation and generally within the range of 200 percent to 1000 percent, preferably 400 percent to 750 percent. Ultimate tensile strength for the elastomeric material must also be sufficient to undergo the needling operation and will be generally within the range of 2000 psi to 5000 psi with a range of 2500 psi to 4200 psi preferred. When the ultimate elongation is less than about 400%, it also must have a rebound generally within the range of from about 25% to 60% and, preferably, within the range of from about 33% to 49%. The permanent set for elastomeric tapes to be used in accordance with the present invention is preferably no greater than about 40% and, more preferably, no greater than about 35%. The tape must also be nontacky by which is meant that it is substantially dry to the touch either inherently or by means of some treatment such as talc addition. This is important since tacky elastomeric materials will accumulate on the needles causing frequent interruptions in seaming.

The combination of properties important to obtaining the desired seam aperture closure include elongation, tensile, rebound and permenant set. For outdoor seaming applications, the elastomeric material will also preferably be resistant to weathering. Materials which satisfy these requirements include neoprene available as Neoprene rubber Stock #7941 from Fulflex, Incorporated and certain grades of natural rubber such as Natural Rubber Stock #3321 also available from Fulflex, Incorporated.

The invention will now be described in reference to specific examples.

EXAMPLE 1

A seam was formed as illustrated in FIG. 1 using as both fabrics to be seamed a nonwoven material as described in U.S. Pat. No. 4,374,888 to Bornslaeger dated Feb. 22, 1983. This material comprised a three layer laminate including outer layers of spunbonded polypropylene having a basis weight of 3.0 oz/yd$^2$ and a middle layer of meltblown polypropylene having a basis weight of 1.2 oz/yd$^2$. These layers were combined by ultrasonic bonding as described in the identified patent. The elastomeric type used in combination with these layers was Neoprene Rubber Stock 7941 having the following properties: dimensions of 0.030 inch $\times \frac{3}{4}$ inch, modulus @ 200% elongation 335 psi, at 500%, 900 psi, ultimate elongation 750%, ultimate tensile 3200 psi, permanent set 12%, specific gravity 1.39. The thread employed was Coats & Clark Quarpel TM treated Tex 90 size polyester core cotton Quarpel TM treated wrap and the combination was needled using a #22 size needle. The resulting combination was then subjected to water repellency testing and a result of 40 cm under the hydrohead test and 0 g absorbed under the rain spray test was obtained. For comparison, a similar seam construction without the tape had test results of only 15 cm under the hydrohead test and absorbed 6.87 g. of water under the rain spray test.

EXAMPLE 2

Using the materials of Example 1, a seam was formed as illustrated in FIG. 2. This seam, when tested for repellency yielded a result of 48 cm hydrohead and 0 g absorbed rainspray.

EXAMPLE 3

Example 2 was repeated using a low modulus butyl rubber which had the following properties: modulus of 175 psi at 100% elongation, 500 psi at 300% elongation, and 1150 psi at 500% elongation; ultimate tensile of 2500 psi; ultimate elongation of 705%; permanent set of 20%; and rebound of 6%. This seam performed in accordance with the invention and produced test results of: hydrohead, 38 cm and rainspray, 0 g.

EXAMPLE 4

Example 2 was repeated using a high modulus butyl rubber which had the following properties: modulus of 360 psi at 100% elongation, and 1425 at 300% elongation; ultimate tensile of 1710 psi; ultimate elongation of 380%; permanent . set of 42%; and rebound of 9%. This seam did not perform in accordance with the present invention in that the hydrohead was 15 cm and the rainspray was 12 g.

EXAMPLE 5

Example 2 was repeated using a low modulus natural rubber which had the following properties: modulus of 200 psi at 100% elongation, 650 psi at 300% elongation, and 2200 psi at 500% elongation; ultimate tensile of 4050 psi; ultimate elongation of 635%; permanent set of 25%; and rebound of 49%. This seam performed in accordance with the invention and produced test results of: hydrohead, 42 cm and rainspray, 1.8 g.

EXAMPLE 6

Example 2 was repeated using a high modulus natural rubber which had the following properties: modulus. of 450 psi at 100% elongation, 1600 psi at 300% elongation, and 3300 psi at 500% elongation; ultimate tensile of 3375 psi; ultimate elongation of 510%; permanent set of 35%; and rebound of 33%. This seam performed in accordance with the invention and produced test results of: hydrohead, 44 cm and rainspray, 1.6 g.

EXAMPLE 7

Example 2 was repeated using a natural rubber which had the following properties: modulus of 260 psi at 200% elongation and 1150 psi at 500% elongation; ultimate tensile of 4000 psi; ultimate elongation of 700%; permanent set of 7%, and rebound of 45%. This seam performed in accordance with the invention and produced test results of: hyrdrohead, 40 cm and rainspray, 0 g. absorbed.

EXAMPLE 8

For comparison, a seam was attempted using the nonwoven materials of Example 1 and an elastomeric material as described in U.S. Pat. No. 2,624,886 to Herman dated Jan. 13, 1953. Seaming had to be discontinued after only 15 inches of stitching due to rubber debris adhering to the needle.

EXAMPLE 9

Also for comparison and using the materials of Example 2 a lap felled seam was constructed employing a polyurethane elastomeric material having the following properties: specific gravity, 1.01; ultimate tensile, 4200 psi, ultimate elongation, 680%; permanent set, 58%; rebound, 5%. This material was available as Pebax 2533 from Rilsan Corporation. The water-repellency test for this seam was unsatisfactory and produced a result of 15 cm. under the hydrohead test and $6\frac{1}{2}$ g. of water absorbed under the rain spray test.

To further illustrate the preferred properties of the elastomeric material of the present invention, samples of the materials used in seams for Examples 7 and 8 were subjected to a modified permanent set test. In this test the samples were stretched to 200% as in the earlier described procedure except that, after stretching, they were immediately released allowing them to react free of restraint. Samples were of a size 19 mm by 76 mm, and the test was otherwise in accordance with ANSI/ASTM Test D412. This modified test demonstrated the ability of the elastomeric material to respond to the stitching process. For the natural rubber and the neoprene samples after 1 minute recovery the percent increase in original length was 2%. On the other hand, the material of Example 8 (U.S. Pat. No. 2,624,886 to Herman dated Jan. 13, 1953) had a percent increase of 8%. The materials of the invention, thus, are better able to quickly reseal about the seaming thread. In accordance with preferred embodiments, the % increase under this test for the elastomeric material is no greater than about 5%.

Comparing the test results it can be shown that a seam formed in accordance with the present invention yields highly improved and unexpected benefits in better seal properties and water-repellency obtained without needle plugging or debris accumulation. Furthermore, the seam of the present invention can be formed rapidly with minor modification of existing equipment and at only a slight additional cost. While other seam improvement techniques have involved the use of elastomeric strips, the unique combinatiuon of the present invention wherein the elastomeric strips possess certain defined properties, may be stitched under normal operating conditions yet results in highly improved sealing characteristics.

Thus it is apparent that there has been provided in accordance with the invention, an improved fabric sealing construction that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. Improved self-sealing seam construction comprising, (a) at least two layers of water-resistant materials, said layers being disposed in overlapping relationship along a seam area, (b) a higly resilient, nontacky elastomeric tape having a quick release percent increase in length of less than 5%, an ultimate tensile strength in the range of from about 2,000 to 5,000 p.s.i., a permanent set less than about 40%, and an ultimate elongation in the range of from about 300% to 1000%, between said layers in the same area, (c) said combination of layers and tape being sewn by thread passing through the combination in the seam area whereby said highly resilient elastomeric tape closes about said thread reducing the tendency of said combination to permit water to penetrate the seam area.

2. The construction of claim 1 wherein the ultimate elongation is less than about 400% and the material has a rebound within the range of from about 25% to about 60%.

3. The construction of claim 1 wherein the elastomeric tape is selected from the group consisting of neoprene and natural rubber.

4. The construction of claim 3 wherein said water-resistant materials comprise nonwoven fabrics.

5. A method of forming a self-sealing seam comprising the step of, (a) providing at least two layers of water-resistant materials, (b) disposing said layers in overlapping relationship along a seam area, (c) providing a highly resilient elastomeric tape having a quick release percent increase in length of less than 5%, and ultimate tensile strength of the range of from about 1,000 to 6,000 p.s.i., a modulus at 500% stretch in the range of from about 500 p.s.i. to 4,000 p.s.i., and an ultimate elongation in the range of from about 200% to 1,000%, between said layers in the seam area, (d) penetrating said combination of layers and tape with a thread containing needle causing an aperture to be formed under stressed conditions passing said thread through the combination in the seam area, (e) withdrawing said needle also under stressed conditions, (f) whereby said elastomeric material closes tightly about the thread within said needle aperture sealing said combination to reduce the tendency to permit water to penetrate the seam area.

6. The method of claim 5 wherein the ultimate elongation is less than about 400% and the material has a rebound within the range of from about 25% to about 60%.

7. The method of claim 5 wherein the elastomeric tape is selected from the group consisting of neoprene and natural rubber.

8. The method of claim 7 wherein said water-resistant materials comprise nonwoven fabrics.

9. The construction of claim 1 in the form of a lap felled seam.

* * * * *